United States Patent [19]

Cassia

[11] Patent Number: 4,676,131

[45] Date of Patent: Jun. 30, 1987

[54] ELECTRIC PAPER CABINET

[75] Inventor: Antonio M. Cassia, Milan, Italy

[73] Assignee: Steiner Company, Inc., Chicago, Ill.

[21] Appl. No.: 847,745

[22] Filed: Apr. 3, 1986

[30] Foreign Application Priority Data

Apr. 5, 1985 [IT] Italy ..... 20243 A/85

[51] Int. Cl.[4] ..... A47K 10/36; A47K 10/38; B26D 5/20

[52] U.S. Cl. ..... 83/208; 83/233; 83/649; 83/734

[58] Field of Search ..... 83/208, 649, 277, 273, 83/237, 436, 734, 649

[56] References Cited

U.S. PATENT DOCUMENTS

| | | | |
|---|---|---|---|
| 3,760,669 | 9/1973 | Rosenthal et al. | 83/208 X |
| 4,137,805 | 2/1979 | DeLuca et al. | 83/649 X |
| 4,212,217 | 7/1980 | Heppner | 83/277 |
| 4,354,408 | 10/1982 | Carte | 83/208 X |

*Primary Examiner*—Donald R. Schran

*Attorney, Agent, or Firm*—Emrich & Dithmar

[57] ABSTRACT

An apparatus for dispensing paper towels of predetermined length includes a housing, a supply roll of a continuous paper web, means for advancing the paper web outside the case, means for at least partially cutting the paper web protruding from the case, and a motor for driving both such means. The motor is an electric d.c. motor which is rotated in a first direction until a paper web of predetermined length is advanced outside the case. The rotation is then reversed so that the paper advancement is stopped and the paper web is out. A first unidirectional coupling means is arranged between the motor and the advancing means and a second unidirectional coupling means is arranged between the motor and the cutting means to selectively actuate either of the advancing or cutting means according to the rotational direction of the motor. The length of the dispensed towel is an integer multiple of an elementary length and the number of elementary lengths by which the paper web is advanced before being but is selected by properly setting a number of switches.

18 Claims, 8 Drawing Figures

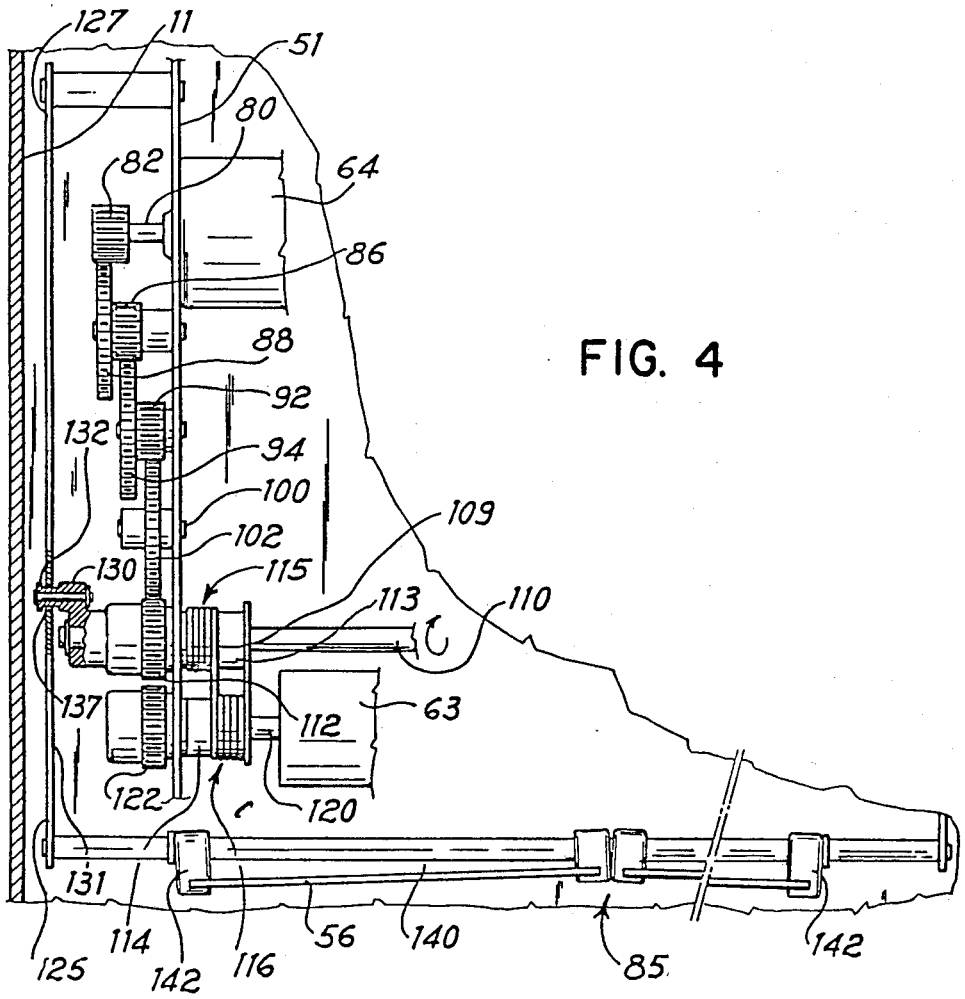
FIG. 4
FIG. 5
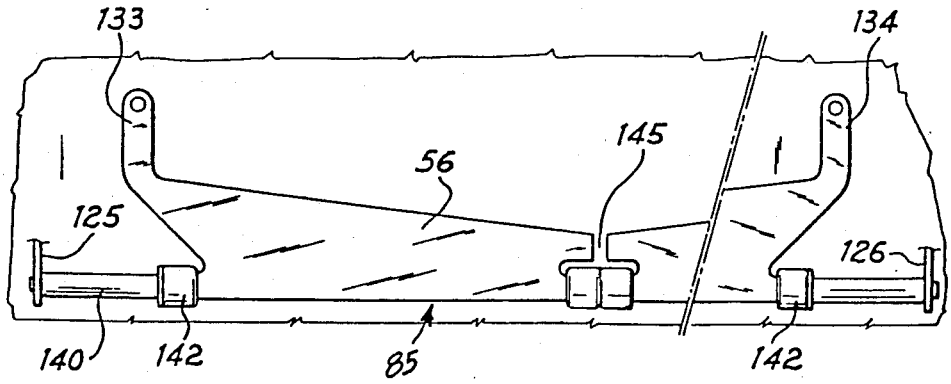

ELECTRIC PAPER CABINET

BACKGROUND OF THE INVENTION

The present invention relates to an apparatus for dispensing paper towels of a predetermined length from a supply roll of a continuous paper web.

There are known dispensers of the above type wherein, upon pressing a push button or a lever, a predetermined length of paper web is advanced outside the dispenser so that the user can detach a paper towel by hand, usually by tearing the protruding web length through a pull action against a saw-toothed blade.

The known dispensers have a number of drawbacks, the most relevant of which are the following. The length of the paper web dispensed each time is rigorously predetermined when designing the apparatus and cannot be altered, or only through replacement of a considerable portion of the dispensing mechanism. This is a disadvantage for the manufacturer forced to market more than one model of the same apparatus or to appreciably modify an existing model to meet the requirements of his customers. Moreover, where the dispensed paper length is either too long or too short, there will be a waste of paper since in the latter case the user will draw more than one towel from the apparatus.

A second drawback of prior art dispensers is that the user must positively detach the dispensed web, often causing the apparatus to jam. It is to be noted that the user's hands are wet when tearing the web preventing use of papers with lower tear strength. On the other hand papers formed of two thin sheets are highly desirable for their absorbency, softness and cost, but cannot withstand a pulling action with wet hands.

A prior art dispenser is described in U.S. Pat. No. 3,408,125 which provides for the manual extraction and cutting of a paper strip by the user, while the apparatus stores a fraction of the power received so that after a predetermined number of cycles, a length of paper to start a new cycle is caused to be fed outward.

U.S. Pat. No. 3,730,409 describes a dispenser apparatus in which cutting the paper web available at the outside is carried out manually by the user and causes the actuation of an electric motor that feeds a further paper length.

U.S. Pat. No. 4,131,044 describes a dispenser of the above-mentioned type, in which a predetermined paper length is drawn manually while some power is stored at the same time for the subsequent operation of a movable blade for cutting the paper web.

U.S. Pat. No. 4,697,146 describes a manually operated dispensing apparatus in which only a prefixed length of paper web can be drawn outside and torn by means of a timer preventing the paper web from unrolling. A fraction of the applied power is stored to cause a length of paper to be fed, after tearing, and to remain accessible from outside in order to start the subsequent cycle. The length of the dispensed strip can be previously selected among two or three values by acting onto the dispensing mechanism.

All these devices provide for a completely manual operation, except for the one described in U.S. Pat. No. 3,730,409 wherein only the feeding operation is motorized and the cut still must be carried out manually by the user. Therefore the above-mentioned drawbacks remain unsolved and even according to the last mentioned patent a certain length of paper is left exposed outside of the apparatus with further inconveniences of hygienic nature.

SUMMARY OF THE INVENTION

It is therefore an object of the present invention to provide a dispensing apparatus for paper webs usable as towels, wherein the length of the dispensed web available outside can be fully adjusted, even by untrained persons without requiring any mechanical adjustment of the dispenser.

Another object of the invention is to provide an apparatus which automatically supplies and partially cuts the dispensed web length so that the towel hangs from the apparatus without falling and can be completely detached with a minimum pulling effort.

A further object of the invention is to provide an automatic towel dispenser which does not require a positive action or a physical contact to be started but can supply the paper towel without being touched by the user.

Still another object of the invention is to provide a dispenser wherein the adjustable dispensing and the cutting of the paper are obtained through the same power means, thus avoiding a second power source, such as an additional motor or temporarily storing means, for actuating a cutting device at the end of the dispensing step.

These and additional objects are achieved by the invention which provides an apparatus for dispensing a predetermined length of a paper web comprising a housing provided with a slot through which the paper web is supplied outside from a supply roll contained in said housing; bidirectional electric motor; means for advancing the paper web through the slot; means for partially transversely cutting the paper web protruding outside said lot; means for selectively coupling the motor either to one of the advancing means or to the cutting means, the motor when coupled to the cutting means advancing the paper web through the slots and when coupled to the cutting means actuating the cutting means partially to cut the paper web; a control circuit for driving the motor when coupled to the advancing means for a duration proportional to the predetermined length, and then driving the motor, after coupling to the cutting means, whereby the dispensed paper web is at least partially cut.

According to a preferred embodiment of the invention, the selective coupling means comprises first undirectional coupling means connecting the motor with the advancing means so that the latter is driven only when the motor is rotated in a first direction and second unidirectional coupling means connecting the motor with the cutting means so that the latter is driven when the motor is rotated in a second direction opposite to the first.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 4 is a partial front view showing the driving gears;

FIG. 5 illustrate the cutting blade for the paper;

DETAILED DESCRIPTION OF THE PREFERRED EMBODIMENT

Figure 1:
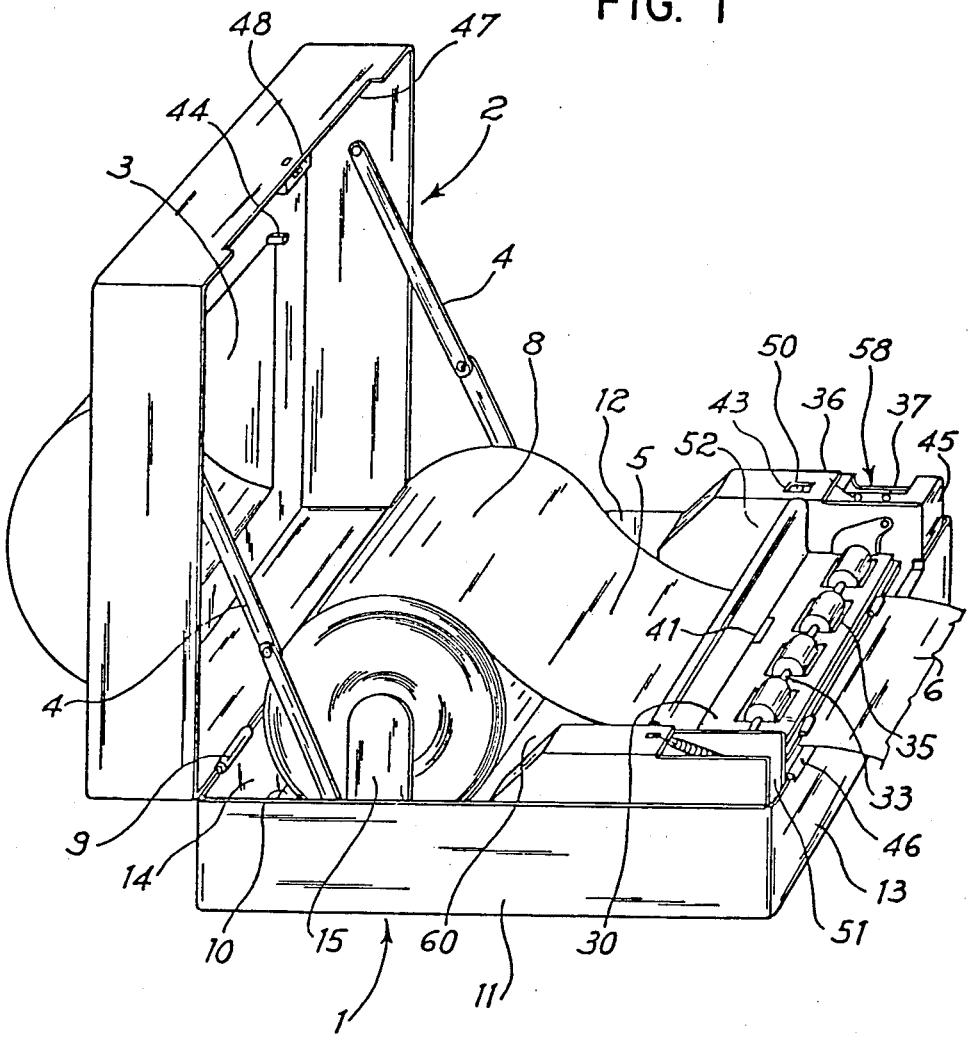
FIG. 1 is a perspective view showing the dispensing apparatus opened.

As shown in FIG. 1, the apparatus according to the invention comprises a case 1 housing the main components which is closed by a cover 2 connected to the case through hinges 9. Both the case and the cover are preferably made of plastic material by molding. The cover 2 is provided with a central portion 3 that is transparent and partially curved to allow for the supply roll 8 of paper carried by the case. Through the transparent portion 3 the quantity of paper still available can be checked. The cover is further provided with a key lock 48 or the like engaging the case to prevent unauthorized opening, and with an elongated notch 47 cooperating with a similar notch 46 on the front (or lower) portion of the case to define an outlet slot for the paper web.

Since the apparatus is preferably mounted vertically, e.g. against a wall or the like, the case and the cover are further connected by a pair of articulated bars 4 adapted to keep the cover lifted when replacing the paper roll or adjusting the length of the paper web to be cut as will be explained later. When the cover is closed a peg 44 protruding from the inner surface of the cover actuates a safety switch 50 in the case so that upon lifting the cover the apparatus is deenergized.

The case 1 comprises a bottom wall 10, two side walls 11, 12, a front wall 13 and a rear wall 14. The bottom wall 10 is provided with means (not shown) for fastening the apparatus to a wall. A pair of brackets 15 rise from the bottom wall to hold the roll 8 of a continuous paper web 5.

Figure 2:
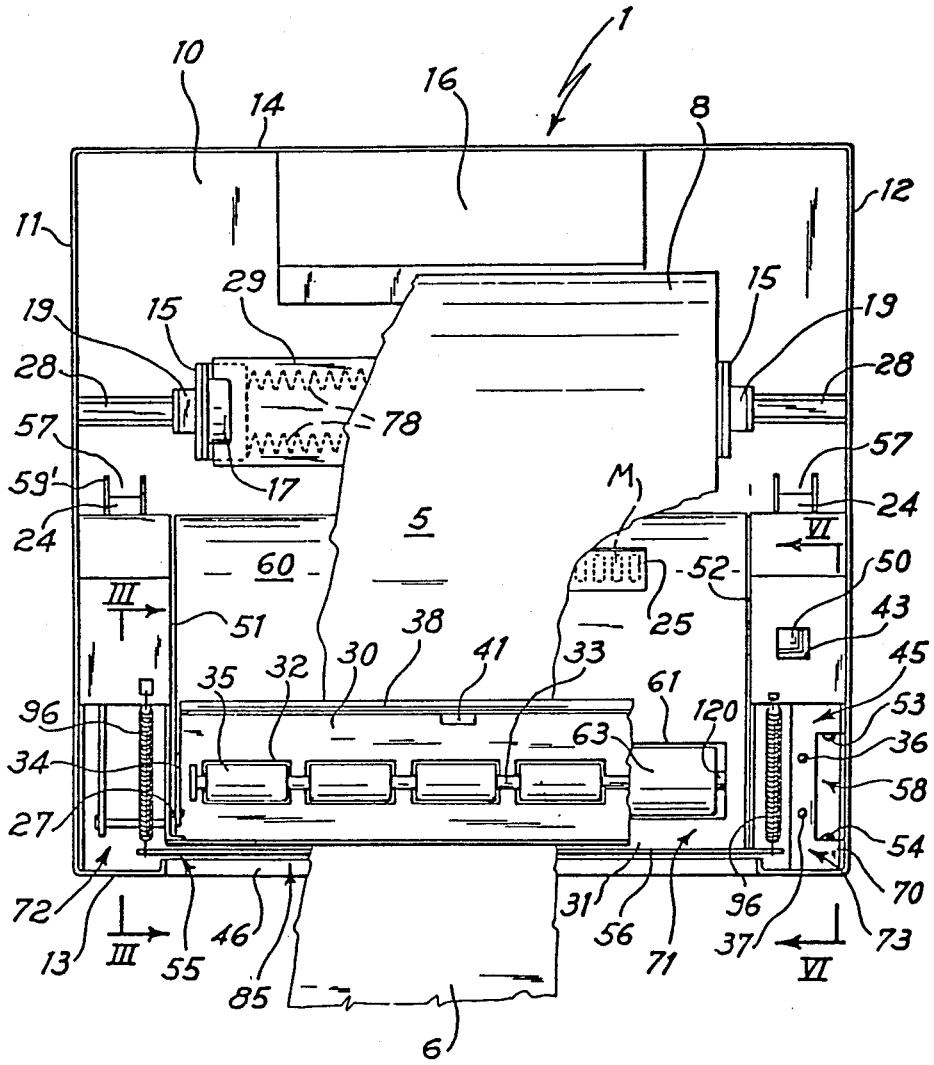
FIG. 2 is a top view of the apparatus of FIG. 1 with the cover being removed.

The remaining part of case 1 is divided into three compartments, a central one 71 and two lateral ones 72, 73 (see FIG. 2). The central compartment 71 is defined by the bottom wall 10, by two uprising lateral metal plates 51, 52 and by an upper partially curved plate 60 upon which is supported the paper web 5 unwinding from roll 8 towards the outlet. As it will be illustrated later, the frame 55 formed by plates 51, 52 and 60 carrying the paper driving mechanism, the control circuit board 39 (FIG. 7) and all the other components is detachable from the bottom wall 10 and fastened to it thanks to elastic pawls 24, 57 formed in the bottom wall.

A tiltable plate 30 is pivotally connected to the lateral plates 51, 52 and defines a passage for the web 5. A shaft 33 is pivotally mounted on this plate 30 and is provided with a plurality of idle rollers 35. Plate 30 is further provided with an opening 41 in correspondence of a similar aperture 59 formed in the plate 60, through which protrudes a tongue 40 connected to a switch 49 (FIG. 8) for detecting the exhaustion of the paper web, as will be better explained in the following. In use plate 30 lays over plate 60 (both preferably of metal) so that the paper web 5 keeps the tongue (40 in FIG. 7) depressed and the associated switch 40 closed. Upon exhaustion of the paper web 5, such to tongue 40 is free to move upward thus opening the associated switch 40 and putting the apparatus out of service. Either condition is displayed outside the dispenser through light indicators 36 or 37, typically LED devices, on the top of the lateral compartment 73 visible on the right portion of FIGS. 1 and 2. Both indicators are visible outside through a pair of small holes (not shown) in the cover.

The right-hand compartment is defined by bottom wall 10, side wall 12 and lateral plate 52 and houses a block 45 having a side recess 58, the two above mentioned light indicators 36, 37 and an aperture 43 into which fits the peg 44 upon closure of the cover 2 to close switch 50 connected to the apparatus power supply by depressing tab 42. A photoelectric arrangement 53, 54 is provided in recess 58 for starting the paper dispensing and the cover 2 is correspondingly shaped so that the user can start the apparatus by placing even only one finger in recess 58 even without touching the recess wall. As seen in FIG. 2 the recess 58 houses an aligned pair of cooperating elements such as a LED 53 and a phototransistor 54 connected in a circuit arrangement such as to start a dispensing cycle when the light beam from the LED does not reach the phototransistor. Of course other optical or proximity devices can be used instead of the represented one.

The left compartment 72 is defined by bottom wall 10, side wall 11 and lateral plate 51 and houses the drive gear (82 to 122 in FIG. 3) for advancing and cutting the paper web 5 as will be illustrated later. As can be seen in FIG. 2, an inner housing 16 is formed adjacent to the rear wall 14 and covers an electrical transformer (not shown), but the housing 16 is unnecessary when the transformer is placed outside the apparatus, e.g. to meet safety provisions requiring that only a low voltage be present in the dispenser.

Brackets 15 of which only one is shown (see also FIG. 1), holding the paper roll 8 are symmetrically and slidably mounted on rails 28 and elastically pushed toward each other against stop members not shown, by means of compression springs 78 in a housing 29 on the bottom. The upper ends of the brackets 15 carry suitable plugs 17 for engaging a paper roll 8 which can be either provided with a core or not. Since the distance between the brackets if adjustable, rolls of different width can be fitted to the apparatus, while maintaining in any case a self-centering arrangement thanks to the above-mentioned symmetrically slidable and elastically pressed mounting.

A paper roll 8 is easily loaded in the dispensing apparatus by further spacing apart the brackets 15 (i.e. pushing laterally on protruding tabs 19), and then releasing them after positioning the roll between the plugs 17.

The advancing, cutting and control devices are all mounted on the metal frame 55 formed by plates 60, 51 and 52, these latter being provided with engaging means with the bottom wall 10 such as metal blades movable in slots (both not shown) in the bottom wall. Two tab strips 57 are formed in the bottom wall 10 by means of cuts 59 extending along the three sides of a C-shaped and the ends of these tabs abut against the higher portion of wedge-shaped projections 24 sloping down to the bottom. When the frame 55 is positioned in the case, these tabs 57 are elastically biased toward the outside and abutting against the frame 55 to hold it firmly in position. By depressing these tabs and pushing the frame 55 toward the brackets 15, the frame 55 can be disengaged and removed, e.g. for maintenance purposes.

A tiltable door 25 (better shown in FIG. 7) is provided in plate 60 for access to the control circuit board 39 and more particularly to a set of microswitches M for adjusting the length of the dispensed paper web.

Figure 7:
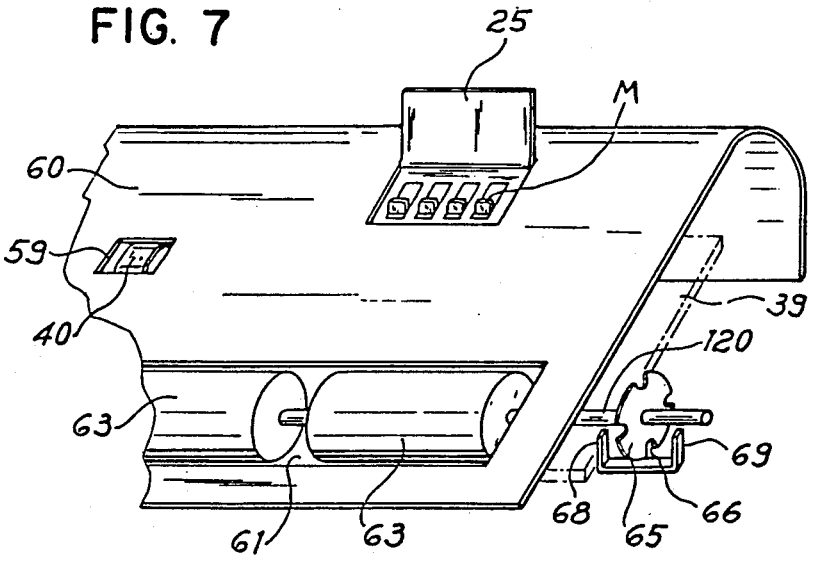
FIG. 7 is a perspective view of the plate supporting the paper web before leaving the apparatus.

The paper web 5 unwinding from roll 8 initially lays over plate 60 and then is guided between plate 60 and plate 30 which is provided with side arms 34 (only one of which is shown), pivotally connected to plates 51, 52 by means of pins 27. Thus the plate 30 can be swung upward when positioning paper web 5. Moreover plate 30 is provided with a longitudinally extending raised portion 38 which abuts against the cover to keep the plate 30 in position when the apparatus is vertically mounted on wall. Plate 30 further carries a plurality of idle rolls 35 mounted on a common shaft 33 connected to plate 30. These rolls 35 partially lean out from plate 30 through openings 32 to contact a plurality of rollers 63 mounted on frame 55. These rollers are the driving or feed rollers of the paper web and are carried by a shaft 120 in the central compartment 77. As also seen in FIG. 7, shaft 120 is journalled between plates 51, 52 at such a position that rollers 63 partially protrude from plate 60 through an elongated opening 61 in this plate. The surface of rollers 63 is such as to frictionally engage the paper web and for example the rollers are covered with rubber.

Without the paper web 5 interposed, rollers 63 and rolls 35 would be in contact with a certain degree of pressure, so that when paper web 5 is present between plates 60 and 30, it is pressed between them when plate 30 is in its working position.

Figure 6:
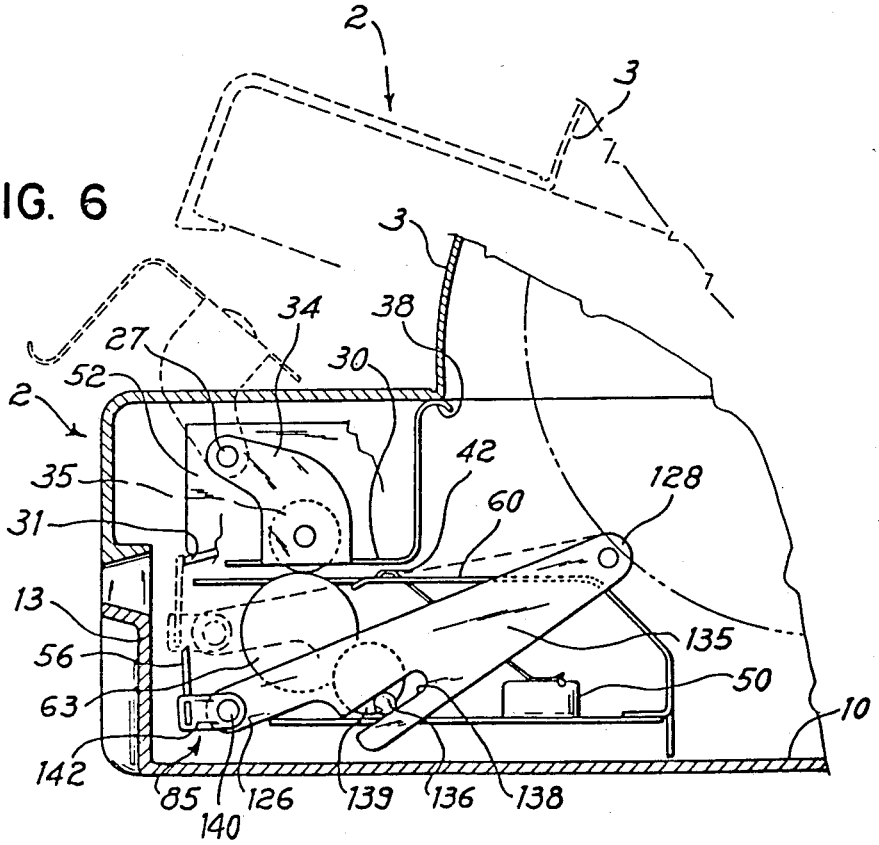
FIG. 6 is a cross-section along line 6—6 of FIG. 2 illustrating the working of the cutting means.

Referring to FIGS. 2, 6 a cutting device 85 is provided at the output of paper web 5 from the space between plates 60 and 30. It comprises a fixed bar 31, mounted between plates 51, 52, and a movable blade 56. Bar 31 has a squared edge whereas blade 56 has a sharp edge and both are preferably of steel. The paper web length 6, accessible from outside is still supported by plate 60 and is advanced to the required length between the fixed bar 31 and the blade 56 and it is cut by the raising of the latter in a scissor-like manner as will be described later in detail.

Figure 3:
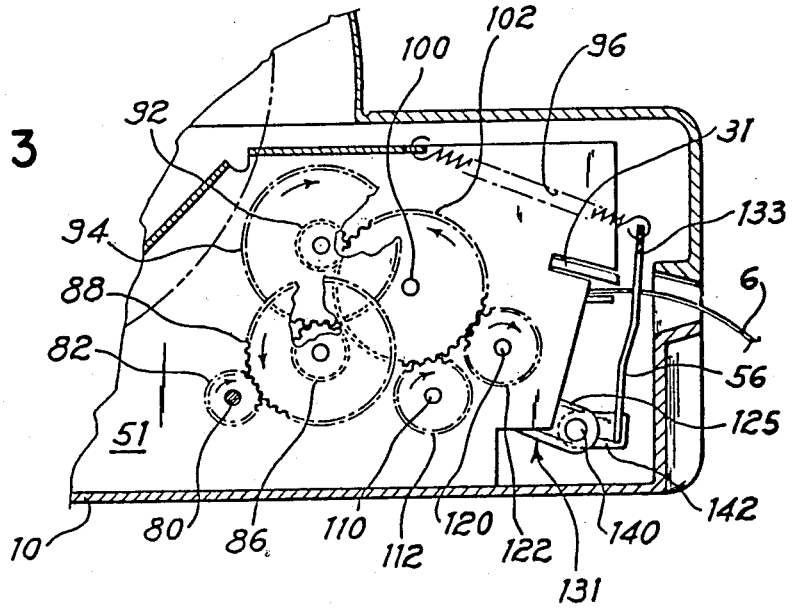
FIG. 3 is a cross-section along line 3—3 of FIG. 2 showing the apparatus driving gears.

With reference to FIGS. 3 and 4 it will now be disclosed the arrangement for advancing and cutting the paper web 5. FIG. 3 is a cross-section taken along line 3—3 of FIG. 2, showing plate 512 on which a plurality of gears is mounted, whereas FIG. 4 is a plan view of the arrangement.

The shaft 80 of an electric d.c. motor 64 housed in the central compartment 71 passes through plate 51 and carries a pinion 82 engaging the outer teeth of a first toothed wheel 88. The inner teeth 86 of this wheel 88 engage in turn the outer teeth of a second toothed wheel 94 having inner teeth 92 driving a third toothed wheel 102 mounted on pin 100. The first 88 to third 102 toothed wheels forms a reduction gear between the motor 64 and two pinions 112 and 122. For clarity sake, in FIG. 4 pinions 112 and 122 are shown as if they were longitudinally spaced apart more than they really are, as can be seen in FIG. 3 wherein it is clearly shown that wheel 102 meshes with both pinions. Apart from pinion 82, all the gears are preferably of nylon or other plastic material.

Pinions 112 and 122 are connected to shaft 110 and 120 respctively, through one-way clutches 115 and 116. Both pinions are freely rotatable in both directions with respect to plate 51 on which they are supported. Clutch 115 couples to pinion 112 to shaft 110 only when pinion 112 is rotated in a counterclockwise direction, when observing FIG. 3, whereas a clockwise rotation of the same pinion does not drive shaft 110. Moreover a shaped cam 130 having a pin 132 is fastened to shaft 110 and is therefore rotated only when this shaft is rotated.

On the contrary clutch 116 couples pinion 122 to shaft 120 only when this pinion is rotated clockwise when observing FIG. 3 while disengaging such a shaft during rotation in the opposite direction. The two one-way clutches 115 and 116 may be for example constructed, as represented in FIG. 4, so as to be extremely simple and of low cost, by using a so-called "pinching" or "throttling" spring 109 with some coils wound around a hub 113 co-axial and integral with shaft 110, and other coils would in an opposite direction on a hub 114 co-axial and integral with shaft 120. One end of the spring 109 is fixed to the case 1 and the other end is free whereby, when the rotation of the two pinions (which has always the same direction) is such as to cause a tightening of coils on one of the two hubs, this is driven in rotation together with the associated shaft, whereas the coils wound in the opposite direction will loosen around the associated hub which is not driven into engagement, thus causing the corresponding shaft to remain stationary. Of course also different types, all know, of one-way clutch would be provided.

In FIG. 3 the arrows show the rotations of the gears for which pinion 22 rotates clockwise, so that it drives shaft 120 with the rollers 63 and the paper web is advanced, whereas pinion 112 although rotating as shown by the arrow, does not drive either shaft 112 or cam 130. On the contrary, when the rotations are reversed, paper advancement is stopped and shaft 110 is rotated. This shaft drives cam 130, as well as an eccentric 139 with pin 136 on the opposite side (see FIG. 6) for actuating the cutting means 85 as will be better described later.

In FIGS. 3, 4, 5 and 6 the construction of the cutting means 85 is clearly shown. Bar 31 is fastened at an end to plate 51 and at the other end to plate 52 (FIG. 6) whereas blade 56 is carried by shaft 140 through fastening blocks 142 (e.g. of nylon) allowing for a limited rotation with respect to the blade. The edge of blade 56 is not parallel to bar 31, as between seen in FIG. 4, for a progressive cutting action and is is interrupted by a recess 145 in the middle so that a central strip of paper web is left uncut after the cutting step.

The reciprocating movement of blade 56 is obtained through levers 131 and 135, in the left and right compartments respectively. The lever 131, 135 have the same shape and are mounted parallel in the frame. One end (127 in FIG. 4, 128 in FIG. 6) of each lever 131, 135, respectively, is pivotally coupled to the corresponding plate (51, 52) whereas the other ends (125 in FIG. 4, 126 in FIG. 6) are connected together by shaft 140 transversely extending through the frame and supporting the blade 56. The upper ends 133, 134 of blade 56 are further connected to plates 51, 52 by elastic means such as springs 96, shown in FIGS. 2 and 3, for a smoother movement.

The middle portion of each lever 131, 135 has a slot 137, 138 (FIGS. 4 and 6) housing a pin 132, 136 mounted on a corresponding cam 130, 139. As already mentioned these cams 130, 139 are rigidly connected each other at the ends of shaft 110 which in turn is coupled to pinion 112 by unidirectional clutch 115. A complete rotation of pinion 112 in a counterclockwise direction causes a reciprocating movement of blade 56 as clearly visible in FIG. 6 wherein the upper position of lever 135 and blade 56 is shown in dashed lines. The same figure illustrates in dashed lines the partially lifted cover 2 and plate 30 fully swung outward.

A device for measuring the length of the dispensed paper web is provided in the right-hand compartment 73 and will be summarily described since it is of convention type (see FIG. 7). It comprises a disc 65 mounted on shaft 120 and provided with a number (e.g. four) of peripheral cuts 66. A detector 68, 69 of the optical type detects the passage of each cut 66 during the advancing rotation of shaft 120 and delivers to the control circuit a number of pulses that is proportional to the length of dispensed web 6.

Figure 8:
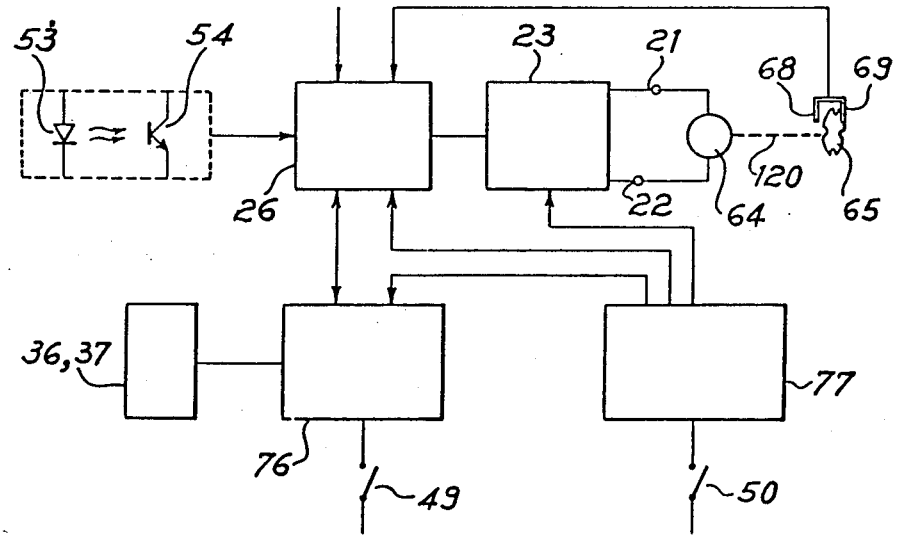
FIG. 8 is a block diagram of the control circuit of the apparatus.

A block diagram of the electric control circuit of the apparatus is shown in FIG. 8. The terminals of d.c. motor 64 are connected to the outputs 21, 22 of a drive circuit 23 which is controlled by a logical unit 26. The motor 64 is kept at rest by supplying an equal d.c. voltage on both outputs 21, 22 (e.g. 12 V). When one of the outputs, e.g. 21, is brought to a near zero voltage, a voltage difference will be applied to the motor terminals, thus driving the moto in one direction. In inverting the above situation the motor 64 will rotate in the opposite direction. Typically the outputs 21, 22 are connected to the collectors of two power transistors (not shown). By driving one of them, into a saturation state, its collector will assume a voltage level of a few tenths of volt thus allowing for the motor rotation. Logical unit 26 receives a start pulse from the photoelectric detector 53, 54 which starts the rotation of the motor 64 in the dispensing direction. This rotation is sensed by the above-described monitoring device comprising a disc 65 with peripheral cuts 66 rotated by shaft 120 and a photoelectric detector 68, 69. In this way a number of pulses proportional to the rotation of rollers 63 (that is to the dispensed paper length) is supplied to the logical unit 26. These pulses are stored and their is compared with the preselected configuration set on the described switches M. When a number of pulses have been received that is equal to the selected one, the motor 64 is stopped and its rotation reversed for a predetermined time to accomplish the complete rotation of pinion 112, i.e. the cut of the web 5. A protection circuit 76 disables the drive circuit 23 in case switch 49 (paper exhaustion) is open and further provides for the control of light indicators 36, 37. A d.c. power supply 77 feeds all the circuits and cuts the feeding upon the opening of the cover 2. The following is a brief description of the operation of the dispensing apparatus according to the invention, as described above.

The apparatus is vertically mounted on a wall or the like and properly connected to the mains for the power supply, so that the light indicators 36, 37 show its state of service. In case the paper roll 8 is exhausted (or the paper web not currently introduced between plates 60 and 30), light 36 signals an out-of-service condition.

To introduce a fresh paper roll 8, the cover 2 is opened by the service personnel with the proper key and lifted until the articulated bars 4 are aligned and keep it open. Upon lifting the cover 2, peg 44 disengages the tab 42, thus opening switch 50 so that the electric power supply is cut off during servicing. A paper roll 8 is mounted and automatically centered between brackets 15 and thereafter plate 30 is tilted forward to correctly position the paper web 5 on rollers 63. Then plate 30 is returned to the original position and the cover 2 is closed again. Paper web 5 is pressed between rollers 63 and rolls 35 by the closed cover 2 pressing on raised portion 38 of plate 30, idle rollers 35 being slightly displaced against the action of spring means (not shown) on which the shaft 33 of idle rollers is mounted. Paper web 5 further presses tongue 40 of switch 49 so that the out of service indicator 37 is off when the cover 2 is closed and paper web 5 in place.

In case the length of the paper towel is to be changed, before introducing the web 5 between plates 60 and 30, the operator opens door 25 and sets a different configuration on the microswitches M of the control circuit board 39. These switches (for example four) represent how many elementary lengths of paper web 5 will be dispensed before the web is cut. As an example, in case all the switches are set on, the maximum length of paper will be dispensed. If only the first switch is sent on and all the remaining are off, the length of the dispensed paper web will be half of the maximum, and so on, according to the rules of binary arithmetics. As an example, the elementary length chosen for the apparatus can be in the order of 2 cm and the maximum length dispensed at each cycle would be 15 times this length, corresponding to binary configuration 1111 of the switches. A table showing the correspondence between the towel length and the configuration of the switches can be attached to plate 60 for easy reference.

When the user moves a finger in recess 58 he interrupts the light beam between the LED 53 and the phototransistor 54 thus starting the dispensing cycle. Known circuit arrangements can be provided to disable further actuation of the apparatus for a predetermined time. The control circuit 23 will drive the motor 64 in a direction such as to rotate rollers 63 and advance the paper web 5 out of the dispenser apparatus. The rotation of shaft 120 carrying the driving rollers 63 will be monitored by the control circuit which compares the number of pulses received from the above-mentioned photoelectric device 68, 69 with the predetermined number deriving from the set switches M. Upon detecting the identify of the two numbers, motor 64 is stopped and driven in the opposite direction for a complete rotation of pinion 112. This way blade 56 performs a reciprocating movement cutting almost completely the protruding web 6 and returning to the original position. Since a narrow middle strip of paper web is left uncut by the presence of recess 145 in blade 56, the towel 6 will remain hanging below the dispenser and can be easily detached by the user. After the cutting, the apparatus is ready for another dispensing cycle.

Possible additions and/or variations can be performed by those skilled in the art to the above-described and illustrated embodiment of the dispensing apparatus according to the invention, without exceeding the scope of the invention itself, with particular reference to the following claims.

I claim:

1. An apparatus for dispensing a predetermined length of a paper web from a paper supply roll, comprising: a housing provided with a slot through which the paper web is fed outside from the roll contained in said housing; a bidirectional electric motor; means for advancing the paper web through said slot; means for transversely cutting at least a part of the paper web protruding outside said slot; means for selectively coupling said motor to said advancing means and to said cutting means, rotated in a first direction is said motor when coupled to the advancing means being capable of advancing the paper web through said slot and said motor when rotated in the opposite direction is coupled to said cutting means being capable of actuating the cutting means to cut the web; a control circuit for driving the motor when coupled to said advancing means for a duration proportional to the predetermined length, and then driving said motor after coupling to said cutting means, whereby the dispensed paper web is at least partially cut.

2. An apparatus for dispensing a predetermined length of a paper web from a paper supply roll, comprising: a housing provided with a slot through which the paper web is fed outside from the roll contained in said housing; a bidirectional electric motor; means for advancing the paper web through said slot; means for transversely cutting at least a part of the paper web protruding outside said slot; first unidirectional coupling means connecting said motor with said advancing means so that the latter is driven only when said motor is rotated in a first direction; second unidirectional coupling means connecting said motor with said cutting means so that the latter is driven only when said motor is rotated in a second direction opposite to the first one; a control circuit for driving said motor in a first direction for a duration proportional to the predetermined length, and then driving the motor in the opposite direction whereby the dispensed paper web is at least partially cut.

3. An apparatus according to claim 2, wherein said advancing means comprises a plurality of rollers mounted on a shaft and a corresponding plurality of idle rolls, each facing one of said rollers, the paper web being pressed between said two pluralities of rollers and rolls.

4. An apparatus according to claim 2, wherein said cutting means comprises a fixed bar and a reciprocating blade, the blade being carried at each side by one end of a lever pivotally connected to said housing at the other end, with a rotatable cam engaging said lever for imparting a reciprocating movement to it.

5. An apparatus according to claim 4, and further comprising a transmission gear connecting the motor with a common toothed wheel rotatable in both directions, said toothed wheel simultaneously meshing with a first and a second pinion, wherein said first unidirectional coupling means comprises a first clutch between a first pinion and said rollers carrying said shaft rigidly connecting said first pinion to said rollers only when said first pinion is rotating in a first direction, and wherein said second unidirectional coupling means comprises a second clutch between a second pinion and a cam actuating the cutting means rigidly connecting said second pinion to said cam only when said second pinion is rotating in a second direction opposite to the first direction.

6. An apparatus according to claim 5, wherein said cam carries a pin housed and slidable in a slot of said lever.

7. An apparatus according to claim 5, wherein said unidirectional clutches each comprise a spring having an end fixed to the apparatus housing and the other end free, with some coils wound about a hub integral to the shaft of the rollers and other coils oppositely wound about another hub integral with said cam, whereby the rotation of the two pinions in one direction causes the loosening of said coils wound on said one hub and the tightening of the coils wound on the other hub, which is thus driven in rotation, the opposite occurring when the direction of rotation of the pinions is changed.

8. An apparatus according to claim 4, wherein the edge of said blade is not parallel to the cooperating bar, and is interrupted by a central recess whereby a narrow central strip of the paper web is left uncut after a complete reciprocating movement of said blade.

9. An apparatus according to claim 2, further comprising a proximity device for starting a dispensing cycle, said device comprises a light beam emitter and a light beam detector spaced apart in a recess formed on the outside of the apparatus housing for detecting the presence of an object between them.

10. An apparatus according to claim 2, wherein said motor, advancing and cutting means, unidirectional couplings and control circuit are mounted on a metal frame which is removably fixed to the housing.

11. An apparatus according to claim 10, wherein said metal frame comprises two parallel plates perpendicular to the bottom wall of said apparatus and a partially curved support plate connecting together said plates.

12. An apparatus according to claim 11, wherein an additional plate is mounted on said support plate being pivotably mounted on said parallel plates to swingably move with respect to said support plate, the paper web to be dispensed being passed between said support plate and additional plate.

13. An apparatus according to claim 11, wherein said support plate has a opening for the access to the control conduit, and a door hinged to the support plate for closing said opening.

14. An apparatus according to claim 12, and further including a safety switch having a tongue elastically protruding from the support plate in correspondence with an opening in the additional plate, whereby the switch actuated by said tongue is opened when the upper web is not present between the support plate and the additional plate.

15. An apparatus according to claim 2, wherein said paper supply roll is supported by means of a pair of brackets slidably mounted on the bottom wall of the housing, elastic means continuously pushing said brackets toward each other to center paper rolls of different widths.

16. An apparatus according to claim 2, wherein the bidirectional electric motor is a d.c. electric motor and the control circuit comprises drive means to feed said motor with a reversible voltage difference.

17. An apparatus according to claim 16, wherein said control circuit further comprises means to compare a number represented by a preselected binary configuration with the number of pulses generated at a constant speed during the advancement of the paper web.

18. An apparatus according to claim 17, wherein the control conduit comprises a number of switches for selecting said binary configuration to be set.

* * * * *